US010041630B1

(12) United States Patent
Huddleston

(10) Patent No.: US 10,041,630 B1
(45) Date of Patent: Aug. 7, 2018

(54) PIPE FITTING WITH SEALABLE ACCESS OPENING FOR LINE TESTING

(71) Applicant: Martin M Huddleston, Copper Center, AK (US)

(72) Inventor: Martin M Huddleston, Copper Center, AK (US)

( * ) Notice: Subject to any disclaimer, the term of this patent is extended or adjusted under 35 U.S.C. 154(b) by 150 days.

(21) Appl. No.: 14/550,520

(22) Filed: Nov. 21, 2014

(51) Int. Cl.
*F16L 55/10* (2006.01)
*F17D 3/01* (2006.01)
*F16L 29/00* (2006.01)

(52) U.S. Cl.
CPC ..... *F17D 3/01* (2013.01); *F16L 29/00* (2013.01)

(58) Field of Classification Search
CPC ..... F16L 29/00; F16L 55/124; F16L 55/134
USPC ..... 138/90, 92, 93, 94
See application file for complete search history.

(56) References Cited

U.S. PATENT DOCUMENTS 1,906,151 A 4/1933 Goodman
2,177,916 A 10/1939 Thomas et al.
2,279,257 A 4/1942 Svirsky
2,299,116 A 10/1942 Svirsky
2,474,047 A 6/1949 Gorzkowski
2,843,154 A 6/1955 Hosking
2,975,637 A 3/1961 Burdick
3,431,945 A 3/1969 Robillard
3,453,869 A 7/1969 Cherne
3,565,468 A 2/1971 Garrett
3,774,678 A * 11/1973 Glorisi ..... B60K 11/02 137/510
3,941,156 A 3/1976 Metzger
4,101,151 A 7/1978 Ferguson
4,380,348 A 4/1983 Swartz
4,429,568 A 2/1984 Sullivan
4,542,642 A * 9/1985 Tagliarino ..... G01M 3/022 138/90
4,602,504 A 7/1986 Barber
4,607,664 A 8/1986 Carney et al.
4,658,861 A * 4/1987 Roberson, Sr. ..... F16L 55/124 138/90
4,683,597 A 8/1987 Taylor, Jr. et al.
4,706,482 A 11/1987 Barber
4,739,799 A * 4/1988 Carney ..... E03B 7/003 137/67

(Continued)

OTHER PUBLICATIONS

Cherne, Air Lock Leak Locator http://cherneind.com/Pneumatic/Air_Loc_Leak_Locator, prior to Nov. 21, 2014.

(Continued)

*Primary Examiner* — James Hook
(74) *Attorney, Agent, or Firm* — Deirdre M Kvale; DMK Intellectual Property Law PLLC

(57) ABSTRACT

A coupling fitting for connecting adjacent pipes. The coupling fitting includes a branchless tubular structure having a sealable access opening to facilitate line testing utilizing the coupling fitting. The sealable access opening is a no-hub opening extending through a body of the branchless tubular structure. The coupling includes a plug to seal the access opening to fluidly connect the pipes for use. For testing an inflatable balloon is placed in a flow passage of the coupling and is inflated via air pressure through the sealable access opening. Upon completion of line testing, the balloon is removed and the access opening is sealed via the plug.

20 Claims, 14 Drawing Sheets

(56) References Cited

U.S. PATENT DOCUMENTS 4,763,510 A * 8/1988 Palmer ..... G01M 3/022 138/90
5,035,266 A * 7/1991 Benson ..... F16L 55/132 138/89
5,137,476 A * 8/1992 Noble ..... H01R 4/36 439/793
5,163,480 A * 11/1992 Huber ..... E03F 7/00 138/89
5,353,841 A 10/1994 Mathison et al.
5,423,345 A 6/1995 Condon et al.
5,431,458 A 7/1995 Schaub et al.
5,558,119 A 9/1996 Condon et al.
6,082,183 A * 7/2000 Huber ..... F16L 55/10 137/254
6,116,286 A 9/2000 Hopper et al.
6,209,584 B1 * 4/2001 Huber ..... E03B 7/003 138/89
6,422,064 B1 * 7/2002 Pampinella ..... G01M 3/04 138/89
6,672,139 B2 * 1/2004 Pampinella ..... G01M 3/04 138/89
7,021,337 B2 4/2006 Markham
7,331,217 B2 2/2008 O'Sullivan
7,481,096 B2 1/2009 Brock
7,549,447 B1 6/2009 Garbo
7,597,118 B1 10/2009 Peterson et al.
7,770,941 B2 8/2010 Ward
8,256,800 B2 9/2012 Ward
8,448,995 B2 5/2013 Ward
8,584,272 B2 11/2013 Ball
8,640,736 B2 2/2014 Coscarella
8,887,768 B2 * 11/2014 Hart ..... G01M 3/022 138/177
2002/0148521 A1 * 10/2002 Condon ..... F16L 55/105 138/94.3
2002/0170611 A1 * 11/2002 Lane, Jr. ..... F16L 55/124 138/89
2003/0111125 A1 * 6/2003 Johnson ..... F16L 55/105 138/90
2003/0127242 A1 * 7/2003 Pilling ..... H02G 15/184 174/138 R
2004/0020269 A1 2/2004 Brewer
2007/0006929 A1 * 1/2007 Wolk ..... F16L 21/005 138/90
2009/0084456 A1 * 4/2009 Mantyla ..... E03B 7/003 138/90
2009/0261576 A1 10/2009 Ward
2009/0261585 A1 10/2009 Ward
2010/0012212 A1 * 1/2010 Coscarella ..... F16L 55/11 138/90
2010/0037977 A1 * 2/2010 Rahimzadeh ..... F16L 55/115 138/96 R
2010/0163131 A1 7/2010 Fehr et al.
2012/0005866 A1 1/2012 Ireland et al.
2014/0138943 A1 5/2014 Aloisio

OTHER PUBLICATIONS

Cherne, Clean Seal, http://www.cherneind.com/pnuematic/Clean_Seal, prior to Nov. 21, 2014.
Cherne, Long Test Ball MS2 Test Ball, http://www.cherneind.com/Pneumatic/Long_Test_Ball_MS2_Test_Ball, prior to Nov. 21, 2014.
Cherne, Pillow Plugs, http://www.cherneind.com/pneumatic/Pillow_Plugs, prior to Nov. 21, 2014.
Ask Me Help Desk—Waste Systems Pressure Testing, http://www.askmehelpdesk.com/plumbing/waste-system-pressure-testing-39504.html, prior to Nov. 21, 2014.

* cited by examiner

PIPE FITTING WITH SEALABLE ACCESS OPENING FOR LINE TESTING

BACKGROUND

Plumbing systems include multiple pipes connected via fittings to form a plumbing line. Plumbing lines for residential and commercial structures include water lines, vent lines and drain lines. Drain lines provide a conduit to discharge fluid and waste to sewer pipes or a sewer system. Plumbing lines including drain lines are tested prior to use to make sure there are no leaks in the system. For testing, the line and pipes are filled with air, water or other flowable medium to detect leaks. Typically, connection of the drain pipe to a sewer pipes or sewer line is sealed to test the drain line or system. The drain line is temporarily sealed by removing the pipe fitting connecting the drain pipe to the sewer pipe or line and capping the drain pipe above the sewer line or pipe. Once the line is tested, the cap is removed and the fitting is reconnected to join the drain pipe or line to the sewer pipe or line.

SUMMARY

The present application relates to a coupling fitting for connecting pipes to form a plumbing line of a plumbing system or alternately a gas line. As described, the coupling fitting includes a branchless tubular structure having a sealable access opening to facilitate line testing utilizing the coupling fitting. A plug seals the access opening to fluidly connect the pipes for use. For testing a balloon is placed in the flow passage of the coupling and is inflated via air pressure through the sealable access opening to seal the line for testing. In the embodiments disclosed, the tubular structure includes a stepped inner diameter to form a stepped contact surface for an inlet pipe and a stepped contact surface for an outlet pipe and a flow passage between the stepped contact surfaces. The length dimension separating the stepped contact surfaces is sufficiently large enough for insertion of the testing device to seal the flow passage. As described, the coupling of the present application is adapted for testing the line in-situs and eliminates the need for a branch fitting or cap to seal the line for testing. This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Figure 1:
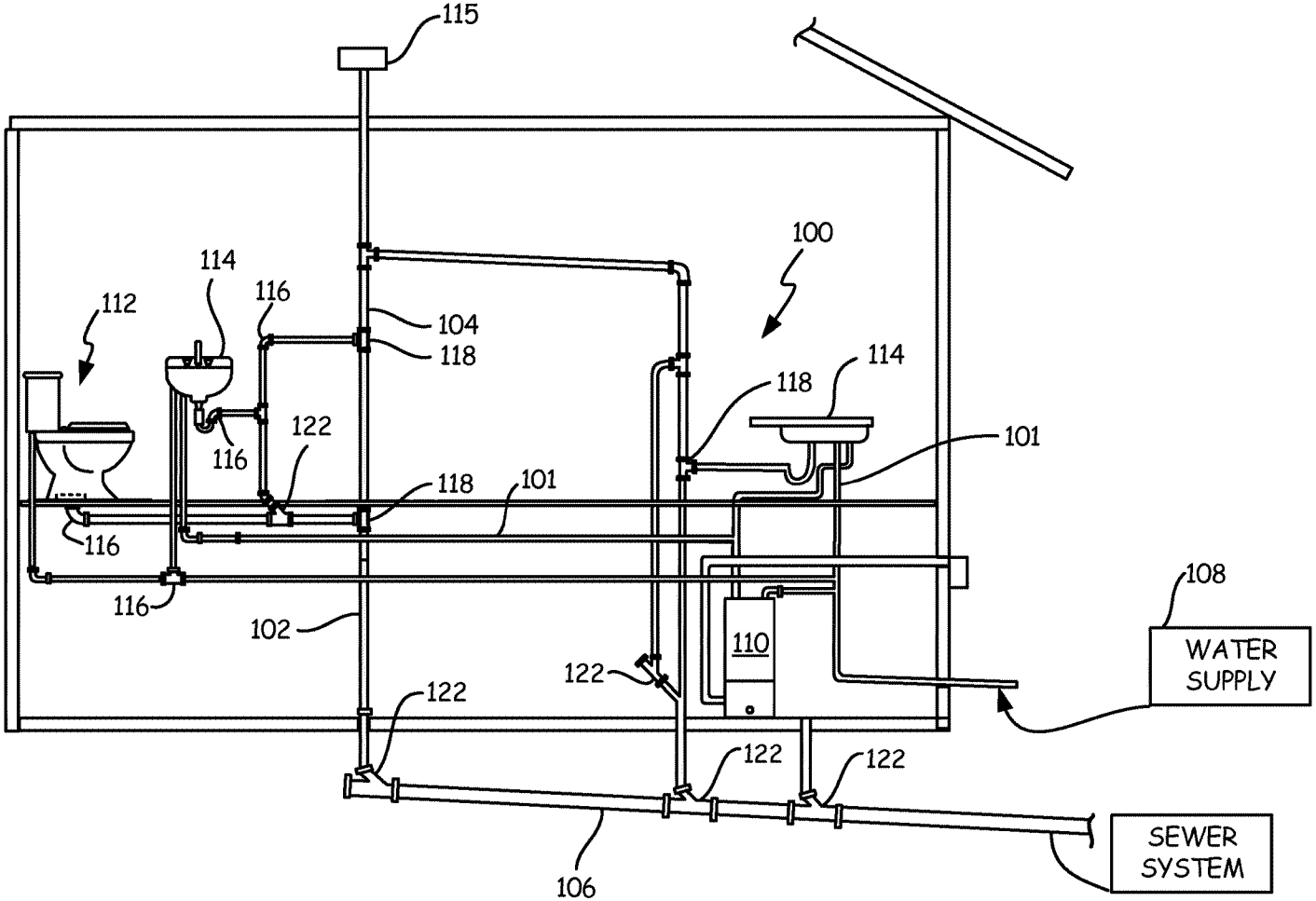
FIG. 1 schematically illustrates a plumbing system for a residential structure including water lines and pipes, drain line and pipes, vent line and pipes and sewer line and pipes.

The present application relates to a fitting for connecting multiple pipes to form a pipeline, such as a plumbing or gas line. The fitting has application for residential plumbing systems 100 as illustrated in FIG. 1, as well as commercial buildings or structures. It should be understood that application of the fittings disclosed herein is not limited to use for plumbing system as shown in FIG. 1 but the fitting has application for connecting other pipes such as gas pipes. The plumbing system 100 shown in FIG. 1, includes water lines 101, drain lines 102, vent lines 104 and sewer line 106. The drain lines or pipes 102 connect to the sewer line or pipes 106 to discharge fluid or waste from the system 100. In the particular embodiment shown, water is supplied from a water source 108 to faucets and other appliances through the water lines 101. In the embodiment shown in FIG. 1, the water source 108 supplies water to a water heater 110, toilet 112 and sinks 114. As shown, drain lines 102 are connected to vent lines or pipes 104 opened to a vent stack 115. The different lines have different pipe diameter sizes as is known in the art and various fittings are used to connect multiple pipes to form the water, drain, vent and sewer lines 101, 102, 104, 106. For example, drain lines use 3" diameter pipes or other size pipes to discharge water.

As shown in FIG. 1 the pipeline includes different fittings to connect pipes to form the pipeline. In particular different fittings connect drain pipes 102 (or other pipes) to form the drain line 102 discharging fluid from toilet 112 and sinks 114. The fittings shown in FIG. 1 include elbow fittings 116, T-branch fittings 118, and Wye Y-branch fittings 122. The elbow fittings 116 shown are formed of a tubular structure having an inlet and an outlet angled at 90 degree angle relative to the inlet to perpendicularly connect lengthwise pipes to upright pipes and upright pipes to lengthwise pipes. In the embodiment shown, elbows 116 connect the toilet 112 and sink 114 to lengthwise pipes and connect the lengthwise pipes to upright pipes. The T-fittings 118 as shown are formed of a tubular structure including a T-branch to provide an inlet, outlet and branch connection to fluidly connect three pipes. In the embodiment shown in FIG. 1, T-fittings 118 fluidly connect lengthwise pipes to upright pipes to connect the sink drain to the upright vent 104 and drain pipes 102. The Wye-Y branch fitting 122 is also formed of a tubular structure and includes a Y branch to provide an inlet, outlet and a branch connection to fluidly connect three pipes as shown in FIG. 1.

Figure 2A:
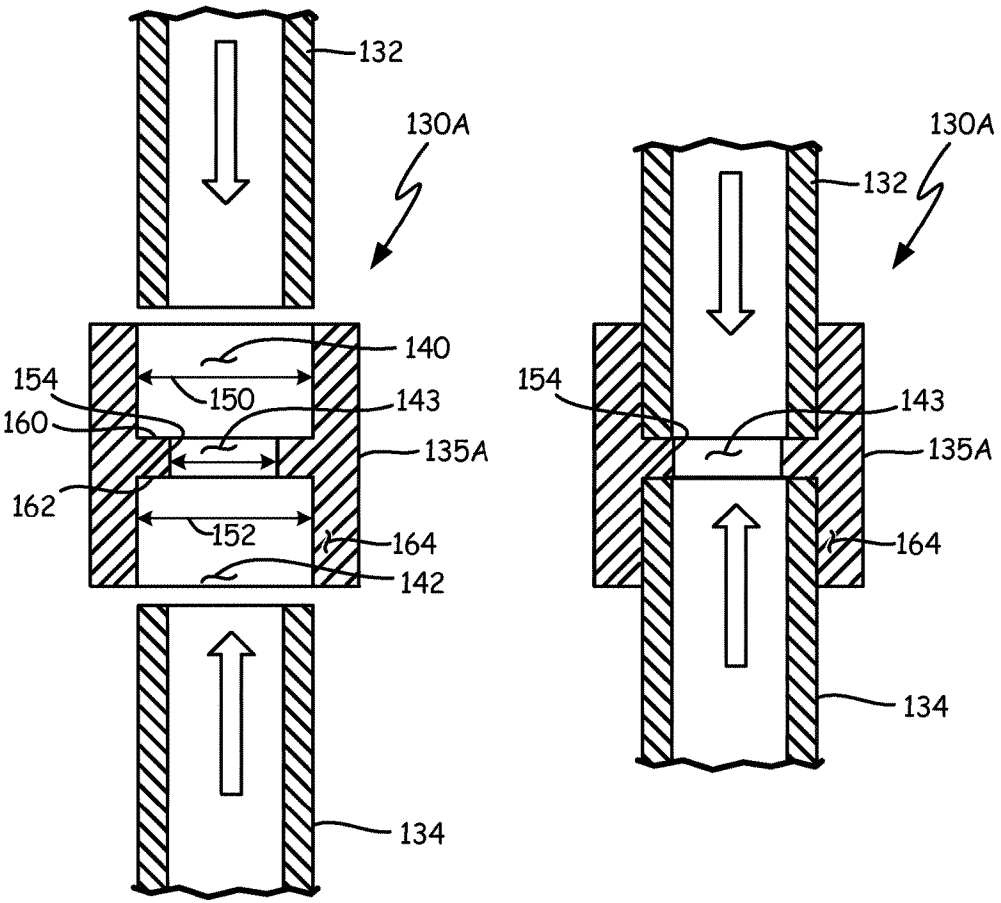
FIGS. 2A-2B schematically illustrate in cross-section different coupling fitting embodiments for connecting pipes.
Figure 2B:
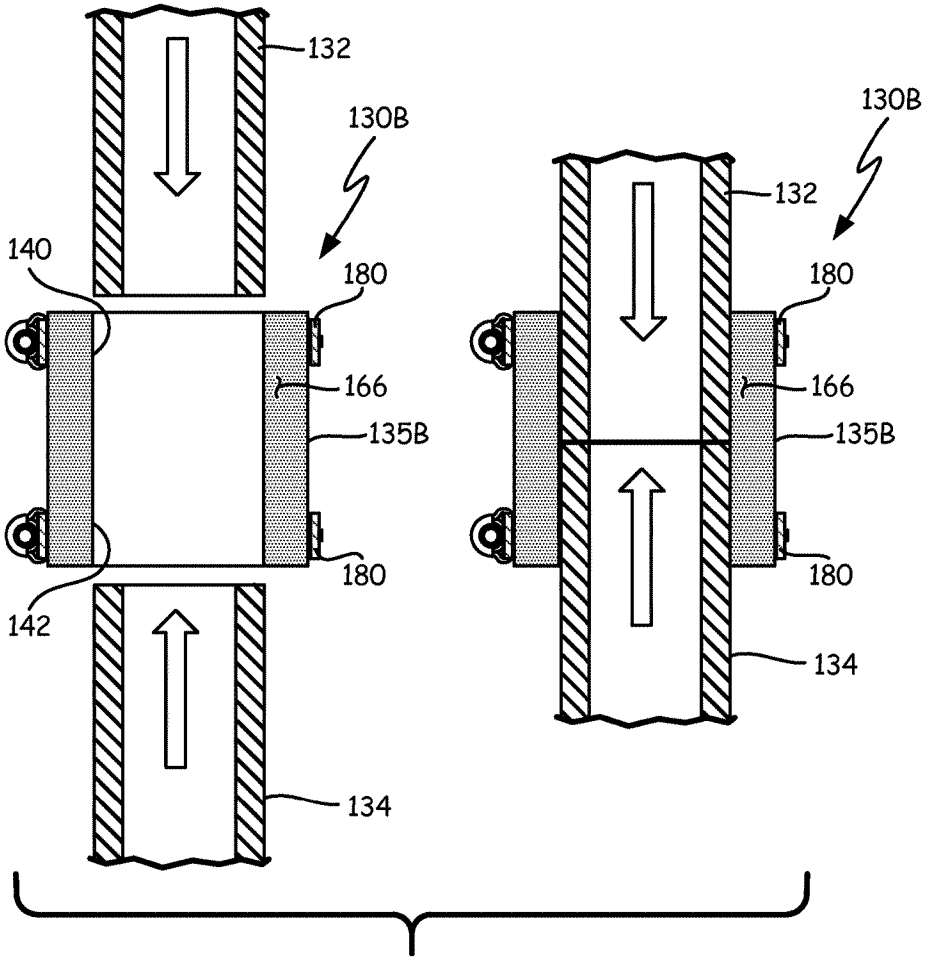

FIGS. 2A-2B illustrate embodiments of coupling fittings 130A, 130B to connect adjacent lengthwise or upright pipes, such as water, vent and drain pipes. As shown in FIGS. 2A-2B, the coupling fitting 130A, 130B connect inlet pipe 132 and outlet pipe 134 as shown in cross-section separately and with the pipes 132, 134 connected to the fittings 130A, 130B. The coupling fitting 130A shown in FIG. 2A is formed of a branchless tubular structure 135A having an inlet 140 and an outlet 142 and a flow passage 143 between the inlet 140 and the outlet 142. The inlet pipe 132 inserts into the inlet 140 of the coupling 130A and the outlet pipe 134 inserts into the outlet 142 of the coupling fitting 130A to connect the pipes 132, 134. As shown, the tubular structure 135A includes an inner diameter 150 at the inlet 140 and an inner diameter 152 at the outlet 142. The inner diameters 150, 152 at the inlet 140 and the outlet 142 are sized for insertion of the inlet and outlet pipes 132, 134. The tubular structure 135A also includes a smaller stepped inner diameter 154 between the inlet and outlet 140, 142. The stepped inner diameter 154 forms a stepped contact surface 160 for the inlet pipe 132, a stepped contact surface 162 for the outlet pipe 134 and the flow passage 143 fluidly connecting the inlet and outlet pipes 132, 134 through the fitting 130A. The branchless tubular structure 135A of the coupling 130A illustrated in FIG. 2A is formed of a rigid tubular body 164 having the stepped inner diameter 154 to form the stepped contact surfaces 160, 162 of the branchless tubular structure 135A.

FIG. 2B illustrates another embodiment of a coupling fitting 130B for connecting adjacent pipes 132, 134 both separately and with the pipes 132, 134 inserted into the inlet and outlets 140, 142 of the fitting 130B. As shown, the coupling 130B is also formed of a branchless tubular structure 135B similar to FIG. 2A. The branchless tubular structure 135B of the coupling 130B shown in FIG. 2B is formed a branchless elastomeric tubular body 166. As shown in FIG. 2B, the elastomeric tubular body 166 is secured to the inlet and outlet pipes 132, 134 via adjustable diameter clamps 180 which tighten about the elastomeric tubular body 166 to secure the coupling 130B to the inlet and outlet pipes 132, 134.

Figure 3B:
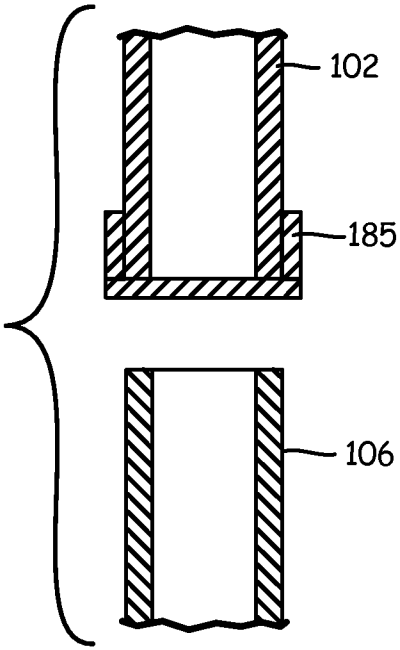
FIG. 3B illustrates drain and sewer pipes with the coupling fitting removed and a cap sealing the drain pipe for testing.
Figure 3A:
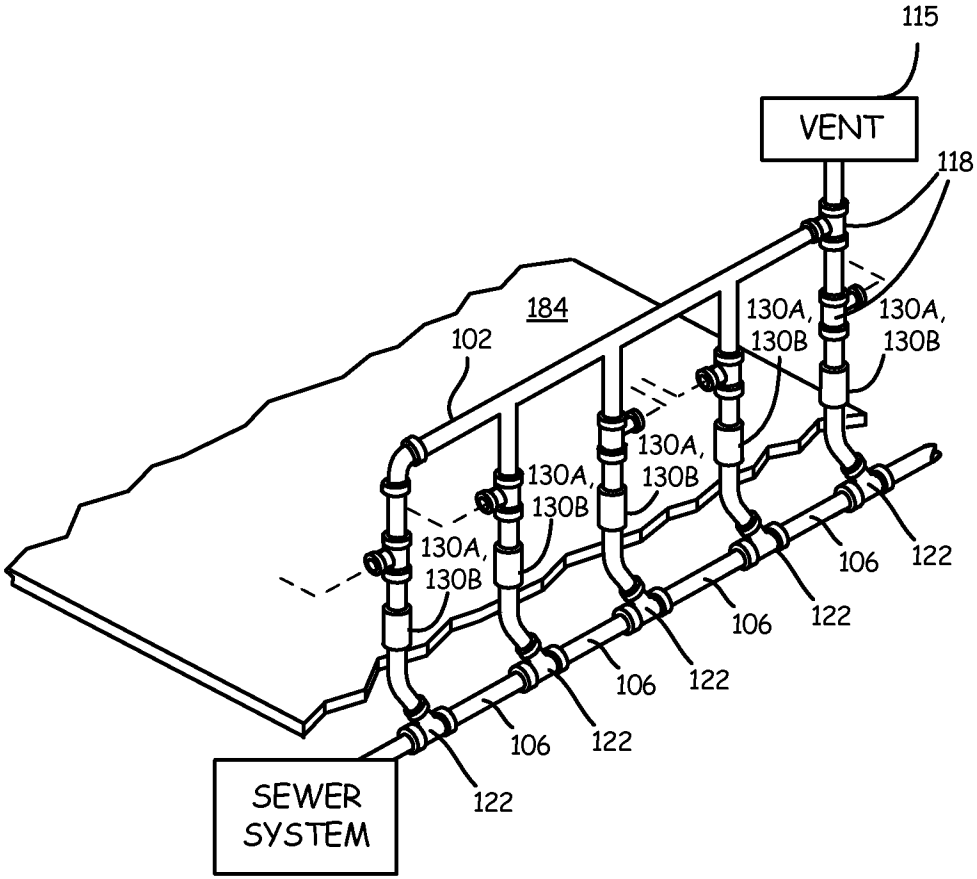
FIG. 3A schematically illustrates coupling fittings along a plumbing wall connecting drain pipes to sewer pipes of a sewer system.

FIG. 3A is a detailed illustration of a plumbing wall of the plumbing system 100 of the type illustrated in FIG. 1, illustrating connection of the drain lines or pipes 102 to the sewer line or sewer pipes 106. As shown, the drain line or pipes 102 connect to the sewer lines or pipes 106 proximate to a foundation or slab 184. Because of the small space, drain pipes 102 are connected to the sewer pipes via coupling fittings 130A or 130B illustrated in FIG. 2A-2B instead of branch fittings 118 or 122, which are expensive and requires more space. Following installation, drain lines 102 of the plumbing system are typically tested to detect leaks. For testing the coupling fitting 130A or 130B connecting the drain pipes 102 to the sewer pipes 106 are disconnected and the pipes 102 are capped via cap 185 as schematically shown in FIG. 3B to test the line. Upon completion of the testing process, the cap 185 is removed and the coupling fitting 130A or 130B is reconnected to reconnect the drain pipe 102 to the sewer pipe 106. The process of capping and reconnecting the pipes 102, 106 is labor intensive and increases expense of installation and testing. The location of the coupling fitting 130A or 130B makes the fitting difficult to access and cap.

Figure 4A:
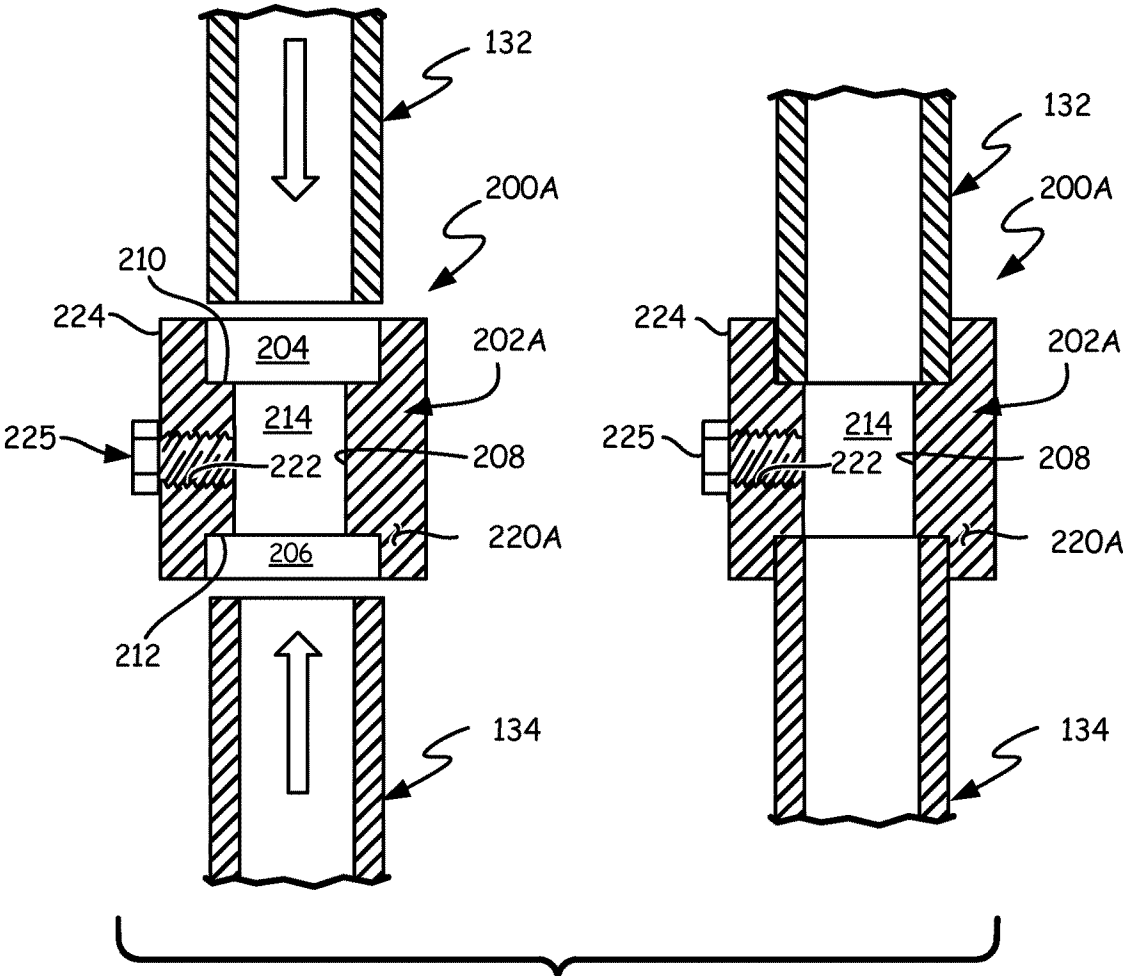
FIGS. 4A-4C illustrate in cross-section, embodiments of a branchless coupling fitting having a sealable access opening to facilitate in-situs testing of a pipeline or plumbing line.
Figure 4B:
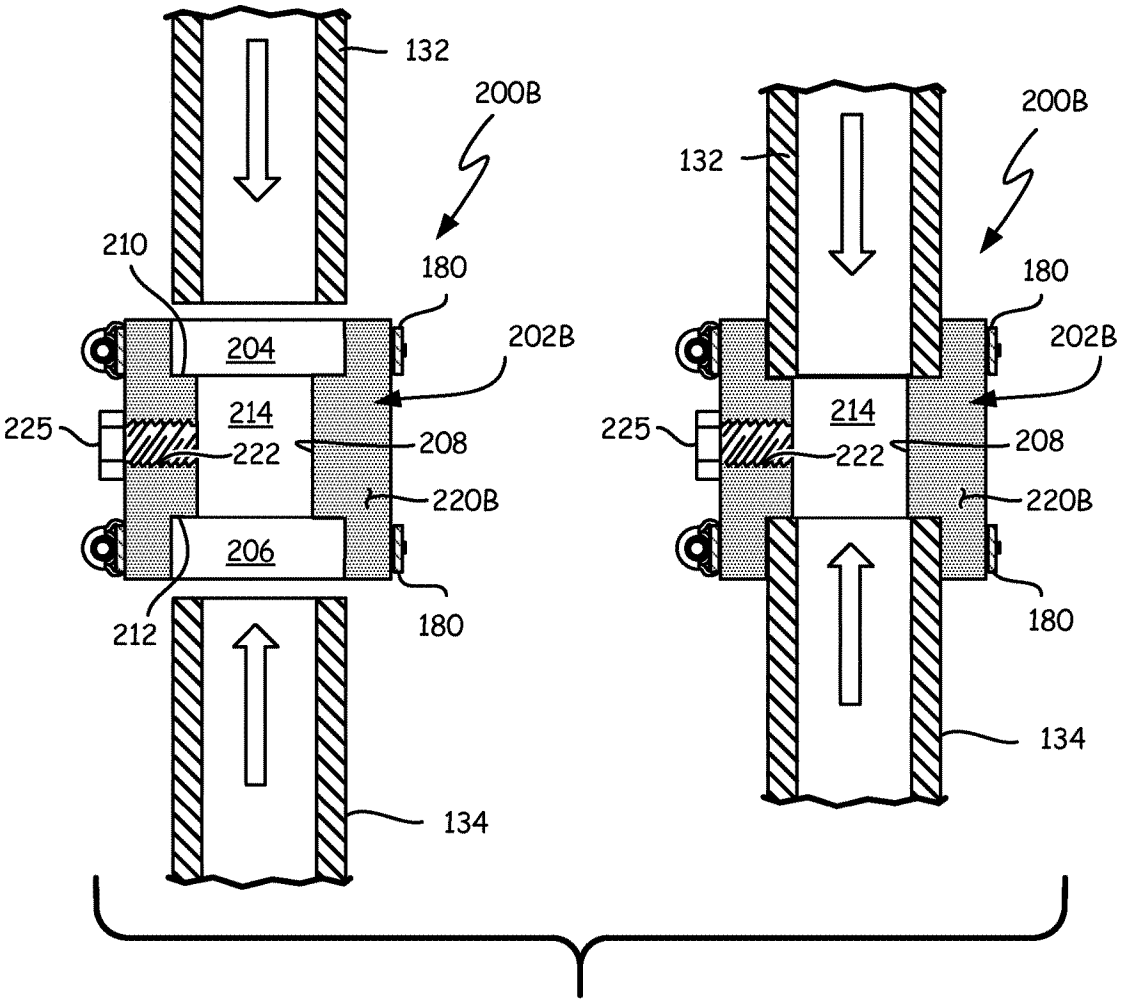
Figure 4C:
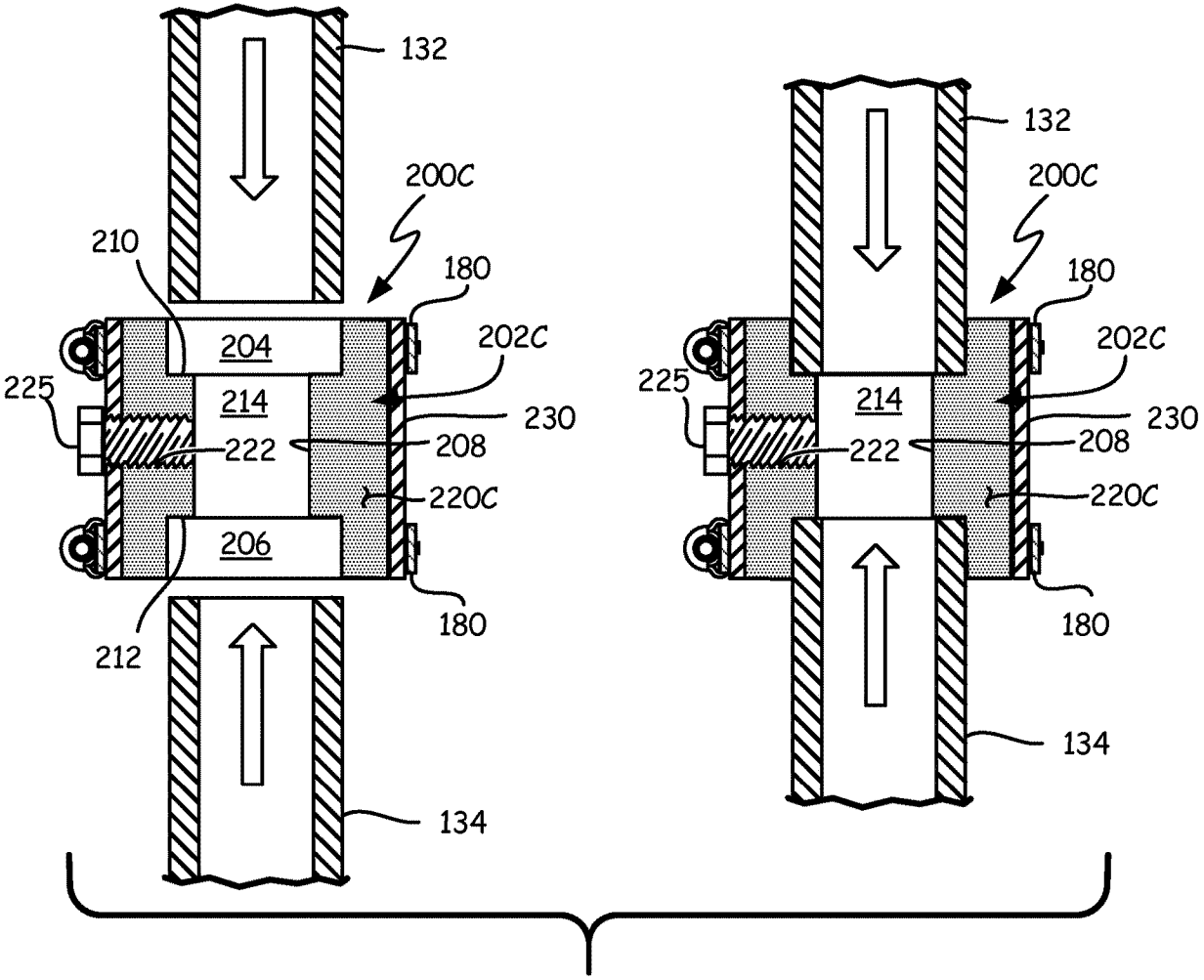

FIGS. 4A-4C illustrate embodiments of coupling fittings 200A-200C adapted for in-situs testing of a pipeline or plumbing system 100 without disconnecting pipes and capping the line. The coupling 200A shown schematically in FIG. 4A includes a branchless tubular structure 202A having an inlet 204, outlet 206 and stepped inner diameter 208 between the inlet 204 and outlet 206 as previously described. In the embodiment shown, the inlet 204 and outlet 206 are coaxially aligned. The inner diameters at the inlet 204 and outlet 206 are sized for insertion of the inlet pipe 132 and outlet pipe 134 and the stepped inner diameter 208 is smaller than the inner diameters at the inlet 204 and outlet 206 to form stepped contact surfaces 210, 212 for the inlet and outlet pipes 132, 134 and a flow passage 214 fluidly connecting the inlet and outlet pipes 132, 134 abutting the stepped contact surfaces 210, 212. In the illustrated embodiment, the diameter dimension of the inlet 204 and outlet 206 is the same dimension, however application is not limited to a fitting having the same inlet and outlet diameter dimension.

In the embodiment shown, the tubular structure 202A is formed of a rigid tubular body 220A formed of a rigid plastic using known molding or fabrication processes. Illustrative materials for the rigid tubular body 220A include Acrylonitrile Butadience Styrene (ABS) or other materials such as black iron, cast iron, ductile iron, copper, or other plastic materials. In the illustrated embodiment, the inlet and outlet pipes 132, 134 are slidably inserted into the inlet and outlet ends of the tubular structure 202A to connect pipes 132, 134. In an alternate embodiment, the inlet and outlet of the tubular structure 202A are internally threaded and pipes 132, 134 are externally threaded to connect pipes 132, 134 to coupling 200A. The stepped contact surfaces 210, 212 in the embodiment shown are perpendicular to the wall thickness of the tubular body 220A and the tubular body 220A has a constant outer diameter as shown, however, application is not limited to the particular tubular body 220A configuration shown.

As shown, the branchless tubular structure 202A of the coupling includes a sealable access opening 222 extending through the tubular body 220A from an outer diameter 224 of the tubular body 220A through a wall thickness of the stepped inner diameter 208 into the flow passage 214 between the inlet stepped contact surface 210 and the outlet stepped contact surface 212. As shown, a depth of the stepped contact surfaces 210, 212 is approximately the same dimension as a wall thickness of the pipes 132, 134. The diameter of the flow passage 214 is also approximately the same diameter dimension as the inner diameter of the pipes 132, 134 to provide a constant flow area or cross-section. As shown access opening 222 of the branchless tubular structure 202A is a no-hub circular opening extending through the wall thickness of the tubular body 220A.

As shown in FIG. 4A, a removable plug 225 seals the access opening 222 to provide a fluid tight coupling between the inlet pipe 204 and the outlet pipe 206. In the embodiment shown, the access opening 222 is internally threaded and the plug 225 is externally threaded to engage the internal threads along the access opening 222 to provide the fluid tight seal. In an illustrated embodiment the rigid tubular body 220A is formed of separate inner and outer tubular portions having different diameter dimensions. The separate tubular portions are assembled to form the rigid tubular body 220A having the inner diameters at the inlet 204 and outlet 206 and the stepped inner diameter 208 between the inlet and outlet 204, 206. In an alternate embodiment, the tubular body 220A is a single piece construction. While a particular coupling 200A is shown, application is not limited to a coupling having a constant outer diameter or a body or structure having perpendicular stepped contact surfaces as shown in FIG. 4A or the particular dimensions shown.

FIG. 4B illustrates another embodiment of a coupling designated as 200B similar to the coupling 200A shown in FIG. 4A where like numbers are used to identify like parts. The coupling 200B includes the sealable access opening 222 extending through a wall thickness of branchless tubular structure 202B similar to coupling 200A. In the embodiment shown, the branchless tubular structure 202B is formed of an elastomeric tubular body 220B having the inlet 204, outlet 206 and a stepped inner diameter 208 between the inlet 204 and outlet 206. Illustratively, the elastomeric tubular body 220B is formed of an elastomeric material such as an elastomeric polyvinyl chloride PVC or other elastomeric material.

In the embodiment shown in FIG. 4B, the tubular structure 202B is a one piece structure elastomeric body 220B having an integrally formed stepped inner diameter 208. In another embodiment not shown, the stepped inner diameter 208 is formed of a separate inner tubular portion concentric with an outer tubular portion to form the tubular body of the branchless tubular structure 202B having the stepped inner diameter 208. The inner tubular portion forming the stepped inner diameter 208 can be formed of a different material than the outer tubular portion to form a composite tubular structure 202B.

As shown, the sealable access opening 222 extends through a wall thickness of the tubular body 220B or structure 202B into the flow passage 214 formed along the stepped inner diameter 208 between the inlet stepped contact surface 210 and the outlet stepped contact surface 212. The access opening 222 is sealed via plug 225 to fluidly connect pipes 132, 134 through the fitting 200B. Fitting 200B includes adjustable diameter clamps 180 as previously described to connect the proximal and distal ends of the branchless tubular structure 202B to inlet and outlet pipes 132, 134. The clamps are tightened against the pipes 132, 134 to provide a fluid tight connection between the pipes 132, 134 and the coupling 200B.

FIG. 4C schematically illustrates another embodiment of the coupling as designated as 200C having a sealable access opening 222 extending through a branchless tubular structure 202C opened to the flow passage 214 between the inlet stepped contact surface 210 and the outlet stepped contact surface 212. In the embodiment shown, the branchless tubular structure 202C includes an adjustable diameter sheath 230 enclosing an elastomeric tubular body 220C forming a gasket. In an illustrated embodiment, not shown, the elastomeric body 220C includes sealing beads at opposed ends to provide a fluid tight seal between the gasket and the pipes 132, 134. The sealable access opening 222 extends through the sheath 230 and through the wall thickness of the elastomeric tubular body 220C into the flow passage 214 formed along the stepped inner diameter 208. Clamps 180 extend about the sheath 230 and are tightened against the adjustable diameter sheath 230 to apply pressure to the elastomeric body 220C to fluidly connect pipes 132, 134.

In illustrated embodiments the elastomeric body 220C is formed of a molded rubber component, such as a molded silicone rubber and the sheath 230 is formed of a stainless steel material. As previously described, the elastomeric body 220C can be formed of a one-piece construction or a multiple piece construction including inner and outer tubular segments forming the stepped inner diameter 208. The clamps 180 as shown extend about the outer diameter of the sheath 230 and are tightened about the sheath 230 to compress the elastomeric body 220C to engage the ends of the pipes 132, 134. As previously described, plug 225 seals the sealable access opening 222 to fluidly connect pipes 132, 134 through the flow passage 214 along the stepped inner diameter 208.

Couplings 200A-200C are used to connect pipes 132, 134 to form a pipeline. As described, the tubular body of coupling 200A is formed of a rigid material such as plastic, ABS, cast iron or ductile iron, or other material to connect pipes 132, 134 formed of plastic, PVC, copper, iron, clay or steel. As described, coupling 200B include an elastomeric body to connect clay, iron, plastic, or copper pipes or pipes formed of other materials to form the pipeline and coupling 200C includes an elastomeric body or gasket and sheath 230 to fluidly connect pipes of various materials including iron, clay, PVC, copper and other materials. In the embodiment shown in FIG. 4A, pipes 132, 134 insert into the inlet and outlet 204, 206 of the coupling 200A to connect the pipes through the branchless tubular structure 202A or fittings. In an alternate embodiment, coupling 200A is threaded to connect to threaded pipes 132, 134 to provide a fluid connection between the inlet pipe 132 and outlet pipe 134 and application is not limited to a particular connection between the pipes 132, 134 and the coupling fitting 200A.

Figure 4D:
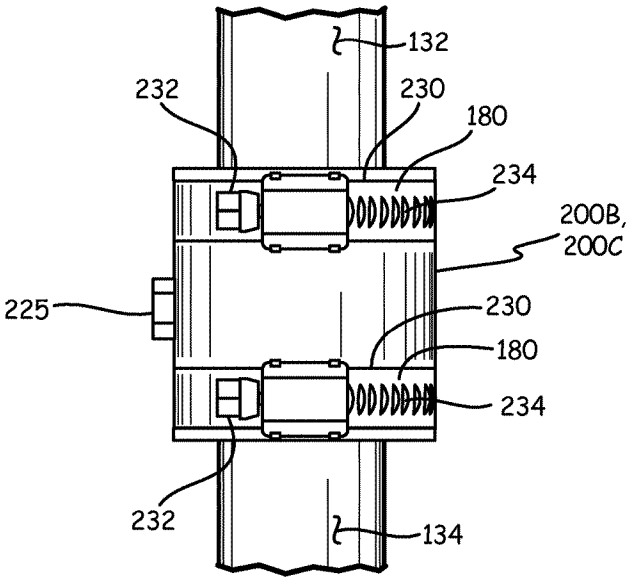
FIG. 4D illustrates an embodiment of the coupling fitting including adjustable clamps connecting the input pipe and outlet pipe.

FIG. 4D illustrates clamps 180 for use with coupling fittings 200B, 200C to connect pipes 132, 134. The clamps 180 shown in FIG. 4D connect coupling fittings 200B or 200C to pipes 132, 134. As shown, the clamps 180 are adjustable band clamps having an adjustable diameter band 230. The diameter of the band 230 is adjusted via a bolt or screw 232 which rotates clockwise and counterclockwise to increase or decrease the diameter of the band 230. In the embodiment shown, rotation of the bolt or screw 232 engages ratchet teeth 234 along the adjustable band 230 to decrease the diameter of the band to tighten the band clamp about the inlet and outlet pipes 132, 134. Illustrative clamps are available from Fastenal Company of Winona, Minn. www.fastenal.com. Although a particular clamp is shown, application is not limited to the band clamp shown and other clamps can be used to connect fittings 200B, 200C to pipes.

Figure 4E:
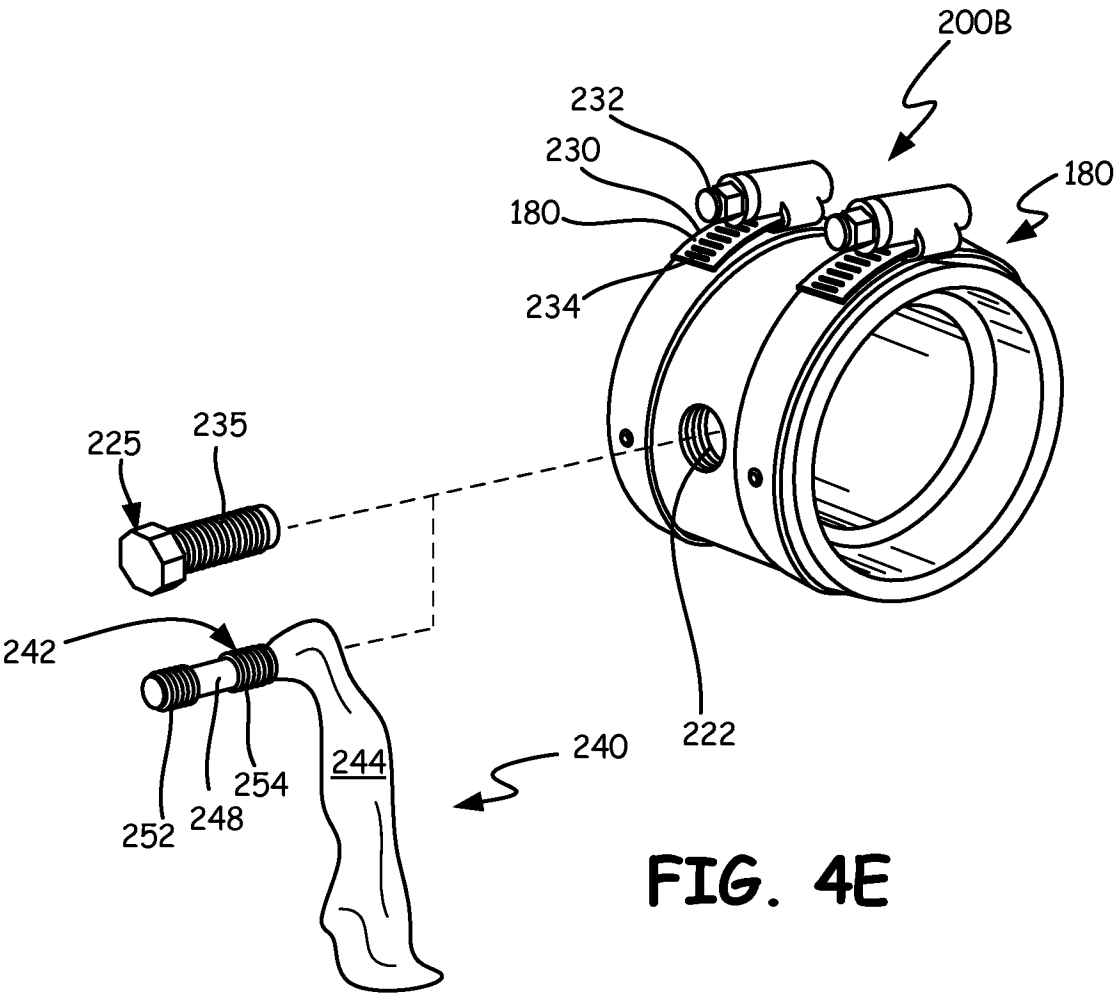
FIG. 4E illustrated an embodiment of the coupling fitting including the sealable access opening and a testing device to facilitate in-situs testing.

FIG. 4E is a perspective illustration for coupling fitting 200B having the sealable access opening 222. The sealable access opening 222 is sealed via plug 225 for use. For testing, a testing device 240 describe below is inserted into the access opening to seal the flow passage for testing.

Figure 5B:
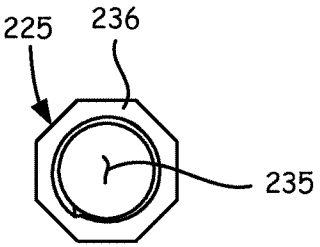
FIG. 5B is an end view of the threaded plug illustrated in FIG. 5A.
Figure 5A:
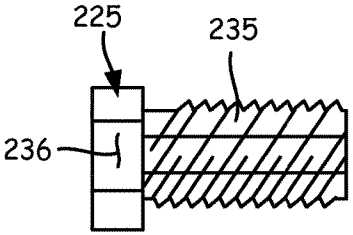
FIG. 5A illustrates an embodiment of a threaded plug to sealing the access opening of embodiments of the coupling fittings illustrated in FIGS. 4A-4E.
Figure 5C:
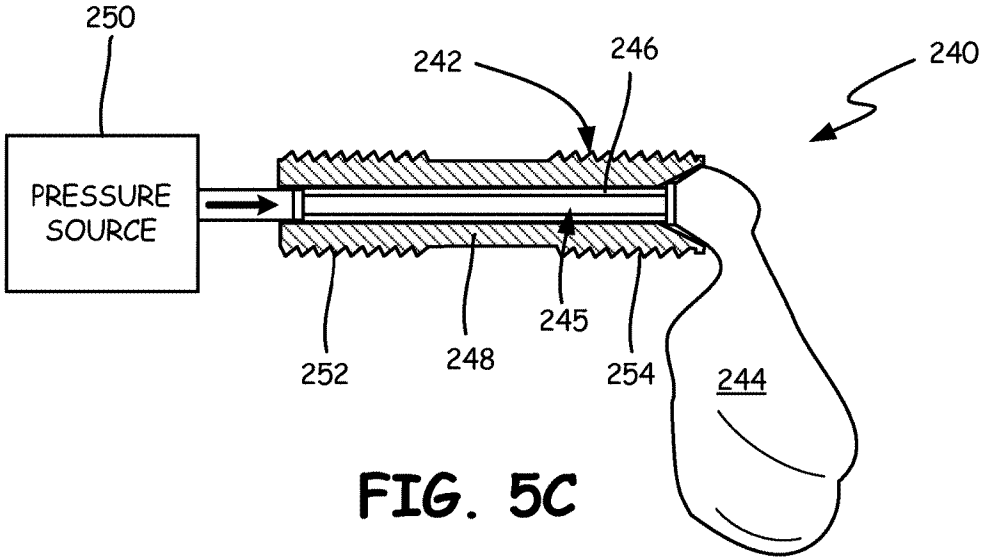
FIG. 5C illustrates an embodiment of a testing device threadably insertable into the access openings of the coupling fittings illustrated in FIGS. 4A-4E to seal the flow passage.

FIGS. 5A-5B illustrates an embodiment of plug 225 threadably connectable to internal threads along the access opening 222 to seal the access opening. As shown plug 225 includes a threaded shaft 235 and head 236. The shaft 235 is sized for insertion into the access opening 222 and threadably connects to threads along the access opening 222. FIG. 5C illustrates an embodiment of a testing device 240 for sealing the flow passage 214 for testing the line without capping or removing the fitting. The device 240 includes a stem valve 242 having an inflatable balloon 244 coupled to the stem valve 242. As diagrammatically shown, the stem valve 242 includes a valve body 245 operable in passage 246 formed through a valve structure 248.

The valve body 245 moves between an opened position and a closed position to open and close the stem valve 242 to fluid or air pressure. In the opened position, the stem valve 242 supplies pressure from a pressure source 250, schematically shown in FIG. 5C, to inflate balloon 244 to seal the flow passage 214. Air pressure is supplied to the inlet of the valve 242 to unseat the valve body 245 to open the valve to inflate the balloon 244 to seal the flow passage as previously described. For use the balloon is inserted through the access opening 222 and air pressure is supplied through the stem valve 242 to inflate the balloon 244. In the illustrated embodiment the stem valve 242 is externally threaded to engage the internal threads along the sealable access opening 222 of the coupling. As shown, the body of the stem valve 242 includes a proximal threaded segment 252 to connect to the pressure source 250 and a distal threaded segment 254 to engage threads along the access opening 222.

Although the testing device 240 illustrated in FIG. 5C includes a stem valve 242 to supply pressure to the balloon 244, application is not limited to the specific testing device 240 embodiment disclosed. For example, the balloon 244 can be used without the stem valve 242 and inflated though a balloon opening which is tied or knotted to maintain the balloon in an inflated condition to seal the flow passage for testing.

Figure 6A:
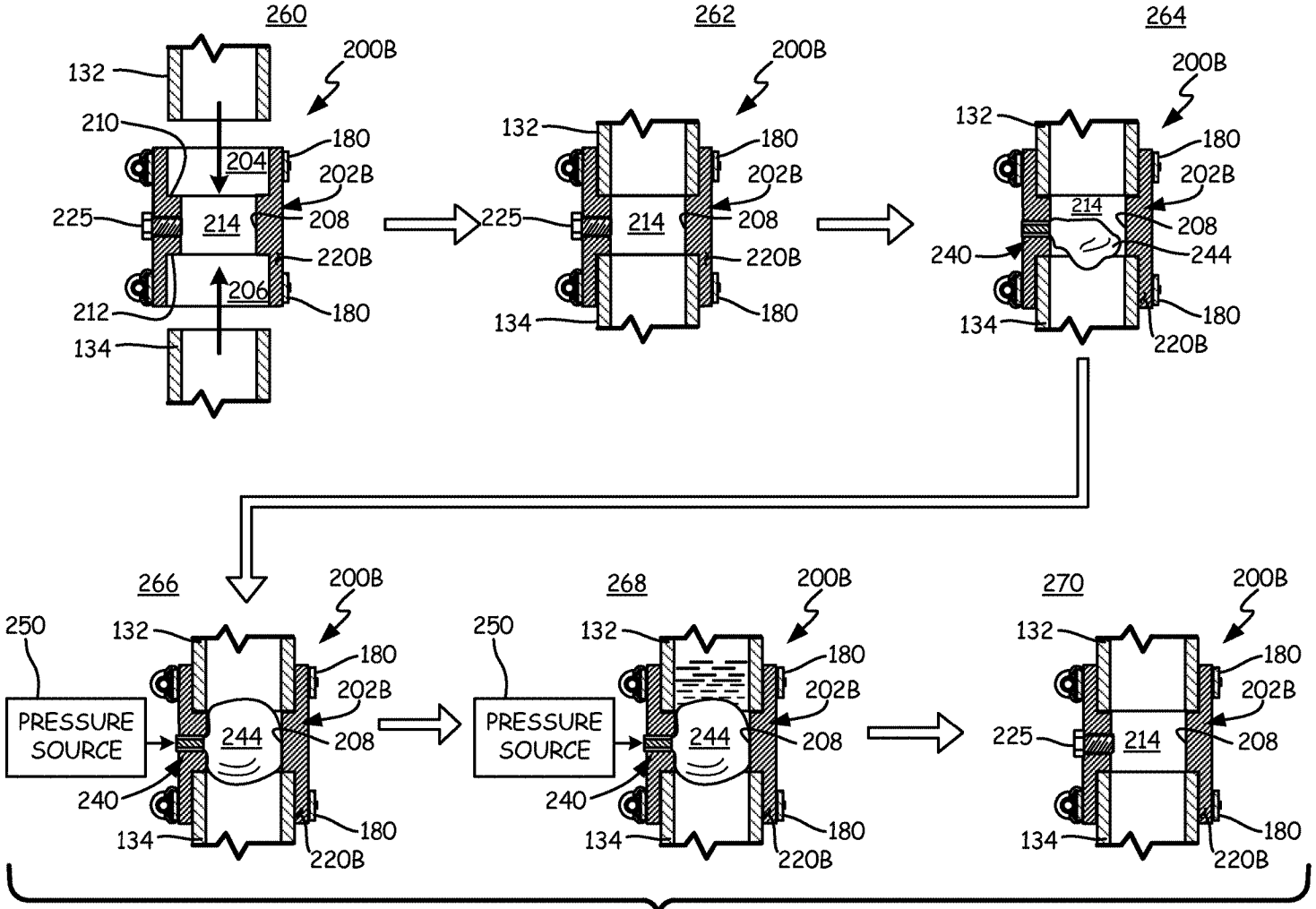
FIGS. 6A-6B illustrate process steps for different embodiments for testing a pipeline using the branchless coupling fittings of the present application.
Figure 6B:
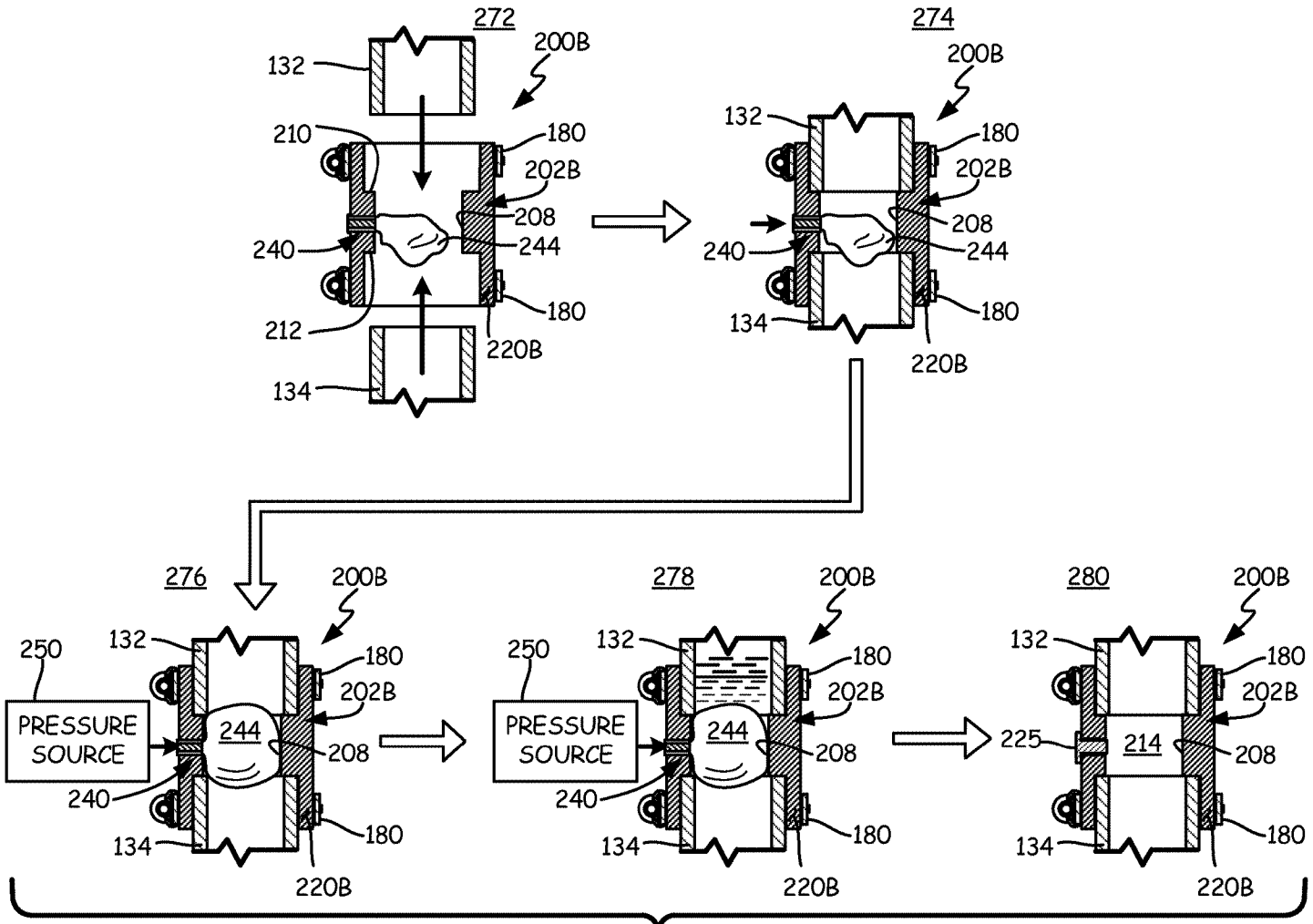

FIGS. 6A-6B illustrate use of the couplings 200A-C for line testing. In FIGS. 6A-6B, the process steps are illustrated using the fitting embodiment illustrated in FIG. 4B, however, the process steps described can be used with any of the coupling fitting embodiments disclosed. As progressively illustrated in steps 260 and 262, inlet and outlet pipes 132, 134 are inserted into the inlet 204 and outlet 206 of the tubular structure 202B with the plug 225 in the sealable access opening. Inlet pipe 132 is inserted to abut the stepped contact surface 210 and outlet pipe 134 is inserted to abut the stepped contact surface 212 to connect pipes 132, 134 as illustrated in step 262. As progressively shown in steps 262 and 264, plug 225 is removed and the testing device 240 with the inflatable balloon 244 is inserted into the flow passage 214. As shown in step 266, the inserted balloon 244 is inflated to seal the flow passage 214. The balloon is inflated via pressurized air from the pressure source 250. As illustrated in step 268, water, air or other fluid is introduced into the plumbing line to test the line while the inflated balloon 244 seals the flow passage 214 between the pipes 132, 134. Following testing, the inflatable balloon 244 is deflated and removed from the flow passage 214 through the access opening 222. Thereafter, the seal plug 225 is inserted into the access opening 222 to seal the flow passage 214 to fluidly connect the pipes 132, 134 as illustrated in step 270. Thus, as shown, the line is tested in-situs without disassembling the line and without complex fittings.

In an alternate embodiment shown in FIG. 6B, inlet and outlet pipes 132, 134 are inserted into the inlet 210 and outlet 212 of the tubular structure 202B having an inflatable device or balloon 244 preinserted in the flow passage 214 along the stepped inner diameter 208 as progressively illustrated in steps 272, 274. Inlet pipe 132 is inserted to abut the stepped contact surface 210 and outlet pipe 134 is inserted to abut the stepped contact surface 212. In step 276, air pressure is supplied to inflate balloon 244 to seal the flow passage 214. As illustrated in step 278, fluid is introduced into the pipeline to test the line while the inflated balloon 244 seals the flow passage 214 between the pipes 132, 134. Following testing, the inflatable balloon 244 is deflated and removed from the flow passage 214 through the access opening 222 and the seal plug 225 is inserted into the access opening 222 to seal the flow passage 214 to fluidly connect the pipes 132, 134 as illustrated in step 280. Thus, as shown, the line is tested in-situs without disassembling the line and without complex fittings as previously described. In the embodiment illustrated in FIG. 6B, if it is not necessary to test the line, the pre-inserted balloon is removed prior to steps 276 and 278 and the plug 225 is inserted to seal the flow passage 214 for use as illustrated in step 270.

Figure 7B:
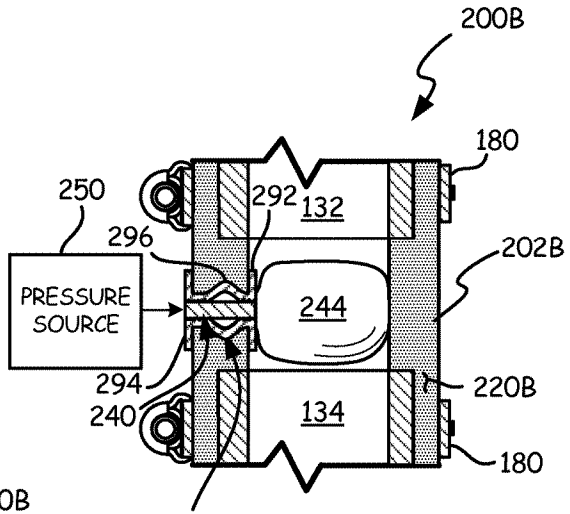
FIGS. 7A-7C illustrate in cross-section, an embodiment of a coupling including the sealable access opening for the branchless tubular coupling of the present application.
Figure 7C:
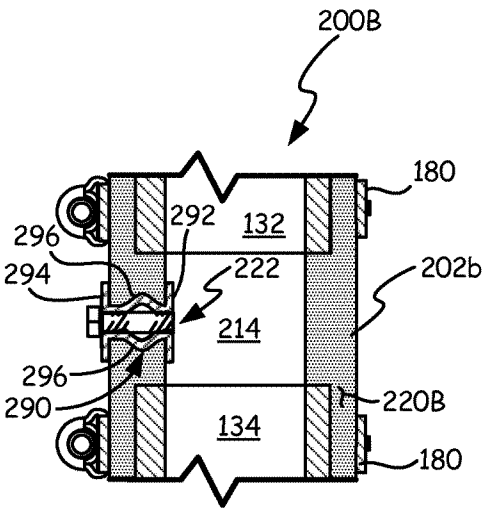
Figure 7A:
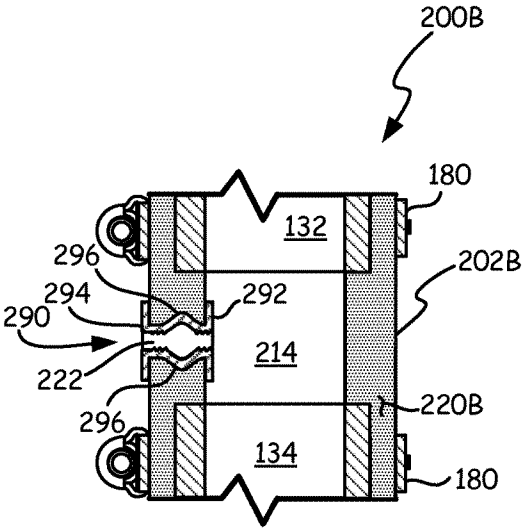

FIGS. 7A-7C illustrate an embodiment of coupling fittings including a jacknut 290 assembled in a hole formed through tubular body 220A-220C to form the threaded access opening 222 of the coupling. In the embodiment shown, the threaded access opening 222 form via jacknut 290 is shown with respect to coupling 200B, but it should be understood that the jacknut 290 can be used to form the threaded access opening 222 for any of the illustrated coupling fittings 200A or 200C. As shown, the jacknut 290 includes an inner ring 292 and an outer ring 294 and a plurality of bendable circumferentially spaced legs 296 connecting the inner and outer rings 292, 294. The outer ring 294 is internally threaded. As shown, the jacknut 290 is installed so that the inner ring 292 abuts the inner surface or diameter of the tubular body 220B and the outer ring 294 abuts the outer surface or outer diameter of the tubular body 220B as shown in FIG. 7A-7C.

As shown, the legs 296 connecting the inner and outer rings 292, 294 are bent to form an inner portion and an outer portion angled relative to the inner portion. The bend legs 296 expand outwardly to engage against the tubular body 220B within the hole extending through the wall of the tubular body 220B to secure the jacknut 290 to the tubular structure 202B and bias the inner and outer rings 292, 294 against the tubular structure 202B to connect the jacknut 290 to the tubular body 220B to form the threaded access opening 222. For testing as progressively shown in FIG. 7B, the inflatable balloon 244 extends through the inner and outer rings 290, 292 into the flow passage 214 and is inflated to seal the flow passage 214. Following testing the balloon 244 is removed and plug 225 is inserted to seal the access opening 222 as shown in FIG. 7C.

In the embodiments shown, the stepped inner diameter 208 and flow passage 214 have a long enough length dimension to provide space so that the balloon 244 can be inserted into the flow passage 214 to seal the flow passage 214 to fluid flow. In the illustration shown, the length of the stepped inner diameter 208 and flow passage 214 corresponds to or is approximately the same dimension as the stepped inner diameter 208 to provide ample space for the balloon 244 to inflate completely to seal the flow passage 214, however application is not limited to the particular dimensions shown.

Figure 8:
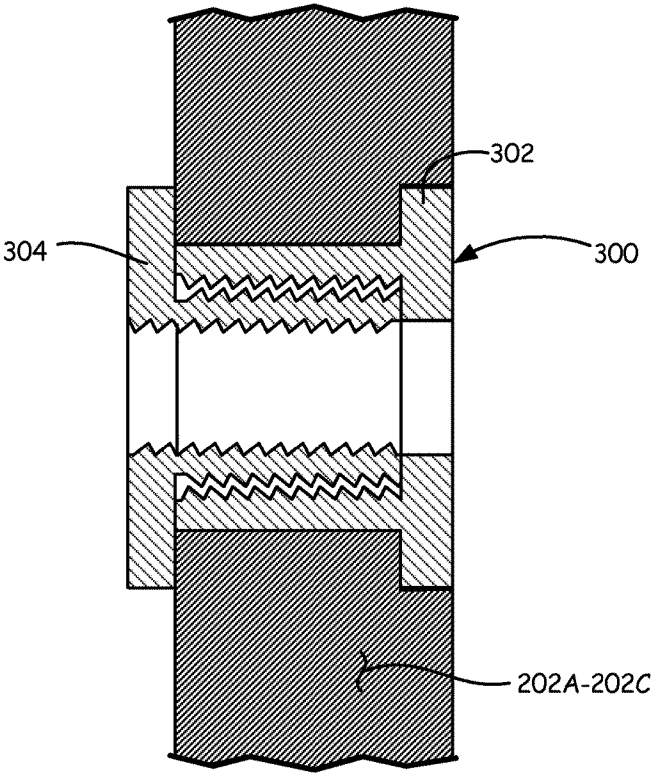
FIG. 8 illustrates in cross-section another embodiment of the sealable access opening for threadably connecting the plug shown in FIG. 5A and the testing device shown in FIG. 5C in the sealable access opening.

In alternate embodiment the threaded sealable access opening is formed of a threaded tubular stud 300 connectable to the tubular structure of the coupling fittings 200A-C as illustrated in FIG. 8. As illustrated the tubular stud 300 includes an inner flange portion 302 and outer flange portion 304. The inner and outer flange portions 302, 304 threadably connect through a hole extending through a wall of the tubular structure 202A-C. As shown, when connected the inner flange portion 302 abuts the inner wall and the outer flange portion 304 abuts the outer wall to secure the stud to the tubular body of structure 202A-202C. As shown, the stud 300 is internally threaded connect to the plug 225 and testing device 240 not shown in FIG. 8 as previously described. In the embodiment shown, the internal threads are along the outer flange to form the threaded access opening 222. In the embodiment shown, the inner flange is recessed into a countersunk bore so that the flange surface is flush with the stepped inner diameter 208 to provide a streamline flow passage 214 through the coupling. Although embodiments of the threaded access opening are described, application is not limited to the particular embodiments shown, for example the access opening can be self-threading.

Although the present invention has been described with reference to preferred embodiments, workers skilled in the art will recognize that changes may be made in form and detail without departing from the spirit and scope of the invention. For example, various elements and components of the illustrated coupling fittings can be combine to form alternate embodiments of a coupling fitting having a sealable access opening to utilize the coupling for testing a pipeline in-situs as described. It should be understood that the coupling fitting of the present application can be a gas coupling, a water line coupling or other coupling and application is not limited to a particular coupling application or size. The coupling disclosed eliminates the need for special fittings and caps to test the line following installation. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections. Further, "connected" and "coupled" are not restricted to physical or mechanical connections. Thus, although the application describes a particular application for drain pipes, application of the coupling described is not limited to drain pipes or a particular size or type of pipe and can be used for gas, water, sewer and other pipelines. Furthermore, although an upright illustration of the coupling and inlet and outlet pipes is shown, application of the coupling is not limited to connecting pipes in an upright orientation.

What is claimed:

1. An assembly comprising a coupling comprising an elastomeric tubular body having an inlet connectable to an inlet pipe and an outlet spaced from the inlet and connectable to an outlet pipe and the elastomeric tubular body having a tubular wall thickness between an inner diameter and an outer diameter enclosing a flow passage having a flow passage diameter connecting the inlet pipe to the outlet pipe;

at least one adjustable diameter clamp to secure the elastomeric tubular body to the inlet pipe and at least one adjustable diameter clamp to secure the elastomeric tubular body to the outlet pipe;

a threaded access opening extending through the tubular wall thickness of the elastomeric tubular body and opened to the flow passage connecting the inlet pipe and the outlet pipe and the threaded access opening having a smaller diameter dimension than the flow passage diameter;

a threaded plug sized for insertion into the threaded access opening to seal the access opening and fluidly connect the inlet pipe to the outlet pipe; and a testing device including an inflatable balloon coupled to a stem valve having a threaded body configured to threadably connect to the threaded access opening and the inflatable balloon having a deflated dimension sized for insertion through the access opening and an inflated dimension sized to seal the flow passage.

2. The assembly of claim 1 wherein the inlet and the outlet of the elastomeric tubular body are coaxially aligned.

3. The assembly of claim 1 and comprising an outer sheath having an adjustable diameter extending about the elastomeric tubular body and tightenable against the elastomeric tubular body and the sheath including an opening coaxially aligned with the access opening extending through the wall thickness of the elastomeric tubular body.

4. The assembly of claim 1 wherein the diameter dimension of the threaded access opening is half ½ the size or less of the flow passage diameter.

5. The assembly of claim 1 wherein the diameter dimension of the threaded access opening is three quarters (¾) the size or less of the flow passage diameter.

6. The assembly of claim 1 wherein the threaded body of the stem valve includes spaced threaded portions including a first threaded portion to threadably connect to the threaded access opening and a second threaded portion to threadably connect to a pressure source.

7. The assembly of claim 1 wherein the elastomeric tubular body includes a stepped inner diameter to form a stepped contact surface for the inlet pipe and a stepped contact surface for the outlet pipe and the flow passage is formed along the stepped inner diameter and the threaded access opening is spaced from the stepped contact surface for the inlet pipe and the stepped contact surface for the outlet pipe.

8. A kit for connecting pipes of a pipeline and testing the pipeline comprising:

an elastomeric coupling including an elastomeric tubular body having an inlet connectable to an inlet pipe and an outlet spaced from the inlet connectable to an outlet pipe and the coupling having a stepped inner diameter and the stepped inner diameter forming a stepped contact surface for the inlet pipe and a stepped contact surface for the outlet pipe and the stepped inner diameter forming a flow passage connecting the inlet pipe and the outlet pipe;

a threaded access opening extending through a wall thickness of the elastomeric tubular body and opened to the flow passage along the stepped inner diameter between the stepped contact surface for the inlet pipe and the stepped contact surfaces for the outlet pipe and the threaded access opening having a diameter dimension sized smaller than a flow passage diameter along the stepped inner diameter;

a threaded plug sized for insertion into the threaded access opening to connect the plug to the access opening to seal the access opening and configured for removal from the threaded access opening; and a testing device including a threaded body sized to threadably connect to the threaded access opening and an inflatable balloon coupled to the threaded body and the balloon is sized for insertion through the access opening into the flow passage in a deflated condition and the testing device connectable to a pressure source to inflate the balloon to seal the flow passage for line testing to provide a low profile test coupling for testing the pipeline.

9. The kit of claim 8 wherein the threaded body of the testing device includes a stem valve connected to the inflatable balloon and having an opened position to provide pressure from the pressure source to inflate the balloon and a closed position.

10. The kit of claim 8 and comprising a plurality of adjustable diameter clamps about the elastomeric tubular body including at least one adjustable diameter clamp to secure the coupling to the inlet pipe and at least one adjustable diameter clamp to secure the coupling to the outlet pipe.

11. The kit of claim 10 wherein the elastomeric coupling includes an adjustable diameter sheath about the elastomeric tubular body having an opening coaxially aligned with the threaded access opening extending through the wall thickness of the elastomeric tubular body and the adjustable diameter sheath tightens about the elastomeric tubular body.

12. The coupling of claim 8 wherein the threaded access opening includes an inner flange and an outer flange and a threaded portion between the inner flange and the outer flange to form a plurality of threads of the threaded access opening.

13. The coupling of claim 12 wherein the inner flange is countersunk within the elastomeric tubular body to limit flow interference through the flow passage.

14. The kit of claim 8 and comprising an inner tubular body disposed in the elastomeric tubular body to form the stepped inner diameter wherein the inner tubular body is formed of a different material than the elastomeric tubular body.

15. The kit of claim 8 wherein the elastomeric tubular body includes a first sealing bead and a second sealing bead spaced from the first sealing bead to provide a fluid tight seal between the inlet pipe and the elastomeric tubular body and the outlet pipe and the elastomeric tubular body.

16. The kit of claim 8 wherein the threaded access opening is formed of an internally threaded jacknut coupled to the elastomeric tubular body and extending through the tubular wall thickness of the elastomeric tubular body.

17. The kit of claim 1 wherein the diameter dimension of the threaded access opening is half (½) the size or less of the flow passage diameter.

18. The kit of claim 1 wherein the diameter dimension of the threaded access opening is three quarters (¾) the size or less of the flow passage diameter.

19. The kit of claim 8 where the threaded access opening is spaced from the stepped contact surface for the inlet pipe and the stepped contact surface for the outlet pipe and the diameter dimension of the access opening is smaller than a length of the stepped inner diameter between the stepped contact surface for the inlet pipe and the stepped contact surface for the outlet pipe for access to the flow passage connecting the inlet and outlet pipes.

20. The kit of claim 8 wherein the threaded body comprises a stem valve having a first threaded portion to connect to the threaded access opening and a second threaded portion to connect to the pressure source.

* * * * *